US007444703B2

(12) United States Patent
Jansen

(10) Patent No.: US 7,444,703 B2
(45) Date of Patent: Nov. 4, 2008

(54) SUPPORT FOR A HUMAN BODY, PARTICULARLY A MATTRESS

(75) Inventor: Klaus Jansen, Buxtehude (DE)

(73) Assignee: Thomas GmbH + Co. Technik + Innovation KG, Bremervörde (DE)

( * ) Notice: Subject to any disclaimer, the term of this patent is extended or adjusted under 35 U.S.C. 154(b) by 0 days.

(21) Appl. No.: 10/549,222

(22) PCT Filed: Mar. 9, 2004

(86) PCT No.: PCT/EP2004/002403

§ 371 (c)(1),
(2), (4) Date: Sep. 9, 2005

(87) PCT Pub. No.: WO2004/080245

PCT Pub. Date: Sep. 23, 2004

(65) Prior Publication Data

US 2006/0260061 A1 Nov. 23, 2006

(30) Foreign Application Priority Data

Mar. 12, 2003 (DE) ..... 203 04 011 U
Mar. 28, 2003 (DE) ..... 203 05 023 U

(51) Int. Cl.
*A47C 27/10* (2006.01)

(52) U.S. Cl. ..... 5/710; 5/655.35; 5/655.5

(58) Field of Classification Search ..... 5/710, 5/713, 655.3, 655.5, 654
See application file for complete search history.

(56) References Cited

U.S. PATENT DOCUMENTS 2,691,179 A * 10/1954 Kann ..... 5/710
3,978,530 A * 9/1976 Amarantos ..... 5/615
4,803,744 A 2/1989 Peck et al.
5,044,030 A 9/1991 Balaton
5,311,623 A * 5/1994 Hendi ..... 5/685
5,586,348 A * 12/1996 Toivio et al. ..... 5/710

FOREIGN PATENT DOCUMENTS

| | | | |
|---|---|---|---|
| DE | 449 464 | | 9/1927 |
| DE | 28 13 309 | C2 | 3/1978 |
| DE | 195 14 945 | A1 | 4/1995 |
| DE | 195 14 945 | * | 10/1996 |
| GB | 379288 | * | 8/1932 |
| GB | 590700 | * | 7/1947 |
| WO | WO 99/49761 | | 10/1999 |
| WO | WO 00/62648 | | 10/2000 |
| WO | WO 2004/080245 | A1 | 9/2004 |

OTHER PUBLICATIONS

EP Office Action dated Feb. 8, 2007.
DE Search Report No. 203 05 023.1 dated Dec. 15, 2004.
EP Search Report No. PCT/EP2004/002403 dated Jul. 6, 2004.

* cited by examiner

*Primary Examiner*—Alexander Grosz
(74) *Attorney, Agent, or Firm*—Laurence P. Colton; Smith, Gambrell & Russell

(57) ABSTRACT

The invention here provides a support, in particular a mattress or a part of a mattress, that preferably has a number of layers (11, 12) of elastic tubes (13). The tubes (13) of each layer (11 and 12) extend parallel to one another. The tubes (13) of different layers (11, 12), however, extend in a preferably crosswise manner to one another. Due to the elastic tubes (13), the inventive support or mattress provides a high degree of sitting and lying comfort with amazingly simple means.

11 Claims, 5 Drawing Sheets

SUPPORT FOR A HUMAN BODY, PARTICULARLY A MATTRESS

BACKGROUND OF THE INVENTION

1. Technical Field

The invention relates to a support for a human body, in particular a mattress for beds, day beds, sitting furniture and the like.

2. Prior Art

Supports of the aforementioned type are known in a variety of forms.

The known supports prove to be disadvantageous in their lack of lying or sitting comfort in the case of supports which can be simply manufactured, or in the disproportionate amount of complexity required to achieve a high degree of lying or sitting comfort.

The object of the present invention is to provide a simple means for producing a support having a high degree of lying or sitting comfort.

BRIEF SUMMARY OF THE INVENTION

The invention achieves this object with a support for a human body, in particular a mattress, for beds, day beds, sitting furniture and the like, characterized by at least one layer (11, 12) of elastic tubes (13) with a longitudinal extension parallel to a plane defined by the support. Accordingly, a support for the human body, in particular a mattress for beds, daybeds, sitting furniture and the like, is provided with at least one layer of elastic tubes, said elastic tubes being tubes with a longitudinal extension parallel to a plane defined by the support. Thus at least one layer forms preferably a core of the support.

The advantage offered by the invention is that a support or a core with at least one layer of elastic tubes can be manufactured quite simply, is lightweight and thus easy to transport, and at the same time offers a high degree of lying or sitting comfort.

The positioning of a plurality of such tubes, aligned parallel to each other and spaced apart from one another in the at least one layer of elastic tubes, results in an overall arrangement that is extremely flexible and permeable to air.

If the mattress or core encompass at least two layers of elastic tubes, the elasticity of the mattress is heightened as a whole. If the alignment of the elastic tubes of the first layer differs from the alignment of the elastic tubes of the second layer, with the tubes of the different layers preferably running crossways to each other, it is possible to influence the elasticity of the mattress in two directions, i.e. in the longitudinal and transverse direction, if the elastic tubes of the first layer are arranged essentially perpendicular to the elastic tubes of the second layer.

The crosswise layout of the different tube layers with respect to one another results in a point contact of the tubes of one layer to the tubes of the other layer. This produces a particularly soft spring deflection in the core that forms the support. Furthermore, the spring characteristic is not linear, thus creating a support which is particularly soft, especially upon initial reclining or resting, providing the person lying on the support an especially pleasant, in particular soft, lying comfort and which surpasses the lying comfort of more complex spring mattresses. Furthermore, the contact points allow for a simple connection of the tubes of different layers to each other.

If the individual elastic tubes are filled, or capable of being filled, with a damping medium, in particular a gaseous or liquid damping medium, in particular air or water, it is possible to set the damping characteristics of the support. If the filled or fillable elastic tubes are connected to each other, particularly as layers or segments, it is possible to achieve pressure equalization within the support, with the result that the damping medium escapes from the heavily loaded tubes and is distributed in the less loaded tubes. When the support is used as a mattress, this arrangement is capable of providing uniform support for the entire human body, since heavier parts of the body sink into the mattress until an equilibrium is achieved with equal support being provided to lighter parts of the body.

The dynamic behavior of such a support, in particular in such a mattress, can be influenced advantageously if the filled or fillable elastic tubes are connected to each other by means of pressure equalization means, in particular flow control means. Ideally, adjustable flow control valves are provided which allow for simple adjustability of the dynamic behavior of the mattress with the help of only one control element. An advantageous fixation of the overall installation can be achieved if the elastic tubes are completely or partially encompassed by an elastic material, e.g. cut polyurethane foam, or are embedded in an elastic material. At the same time, this makes it possible to achieve a bridged and, where appropriate, a flat surface area, thus improving the lying comfort even more.

When the elastic tubes of the first layer have a diameter that differs from the diameter of the elastic tubes of the second layer, it is possible, for example, to provide the outer side of the support with a layer of elastic tubes having a smaller diameter and thus with a greater total number of elastic tubes, and is thus capable of achieving even better and more uniform pressure equalization. The elastic tubes with a larger diameter at the interior of the mattress, on the other hand, provide fundamental damping and/or basic stability.

If the elastic tubes in the different layers are filled with different damping media, such as air as the damping medium in an outer layer and water as the damping medium in an inner layer, it is possible to take advantage of the characteristic insulating property of air for the top side of the support that faces the human body and the incompressibility of water in the interior of the support.

The invention also provides at least some elastic tubes with a fire-retardant or fireproof medium. The tubes employed are filled entirely or partially with the fire-retardant or fireproof medium. This medium can at the same time serve as the damping medium. Preferably, only some, in particular all, elastic tubes of a top layer are filled at least partially with a fire-retardant and/or fireproof medium. A typical fire-retardant and/or fireproof medium can be an extinguishing agent such as water or a liquid used in fire extinguishers. But this medium can also be an additive that is mixed with a damping medium.

The elastic tubes are formed in a particularly advantageous manner by means of welding and, if necessary, the punching out of two foils. Alternatively, the elastic tubes are hose-like, in particular flexible tubes.

A plurality of support of the type described above can be combined to form a mattress if they are arranged adjacent to or above one another. When the pressure of the damping medium in the elastic tubes of a first such support can be adjusted independently of the pressure of the damping medium in the elastic tubes of a second such support, it is possible, for example, to adjust the damping characteristics of a head and/or foot region of a mattress differently than the characteristics of a middle section for the torso. The damping characteristics of the individual supports combined to form a mattress can be advantageously determined when each support is filled or fillable with different damping media.

The advantage of the invention and its embodiments is that, in particular, the support is especially suitable for use in situations requiring a low-weight solution that offers superior comfort, i.e. in the area of what is known as "mobile sleeping arrangements". The support is characterized by its competitive manufacturing costs and its high long-term stability. Furthermore, the height of mattresses formed by such supports can be increased by adding further layers of the elastic tubes.

Further advantageous embodiments of the invention are the subject matter of the dependent claims.

BRIEF SUMMARY OF THE DRAWINGS

In the following, a preferred embodiment of the invention will be described in more detail on the basis of the drawing. Components or elements which correspond to one another are designated in all figures with the same reference number. The figures show.

DETAILED DESCRIPTION OF THE PREFERRRED EMBODIMENTS

Figure 1:
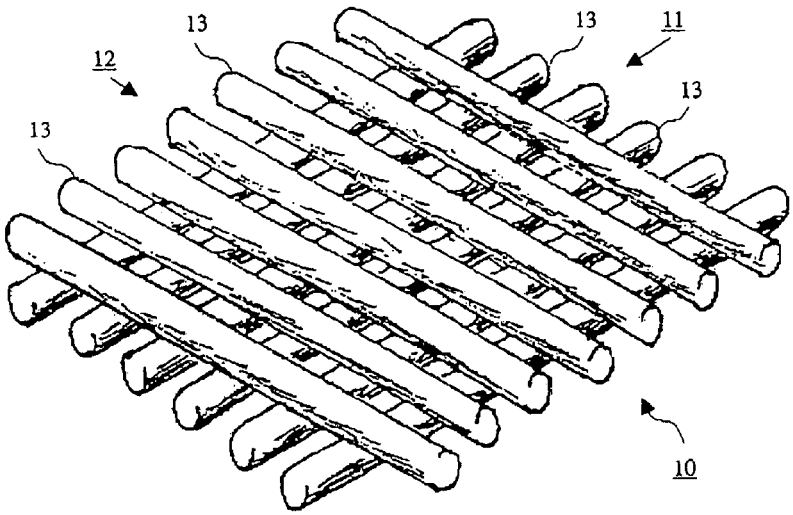
FIG. 1 shows two layers of elastic tubes, in particular as the core of a support for the human body

FIG. 1 shows a core 10 for the human body that is formed by two horizontal layers 11, 12 of elastic tubes 13 lying on top of one another. The core 10 can be encompassed by a sheathing (not shown). Alternatively, however, the entire support can be formed by the layers 11 and 12.

The elastic tubes 13 have preferably a circular cross-section, although other sectional profiles are suitable for implementing the invention, for example, cross-sections having an oval, elliptical or polygonal profile. The height of the core 10 of the support is determined by the diameter of the individual elastic tubes 13 and the number of the layers 11, 12. The centerline of all elastic tubes 13 in each layer 11, 12 of elastic tubes 13 defines a plane. The support encompassing the core 10 rests on a piece of reclining or sitting furniture (not shown) such that the core 10 and its aforementioned plane is arranged parallel to one or more support surfaces of the reclining or sitting furniture. Each one of the elastic tubes 13 has a longitudinal extension parallel to the plane defined by the support. The elastic tubes 13 of each layer 11, 12 are aligned parallel to each other and spaced apart from one another, with the parallel centerlines of all tubes 13 of one layer 11 intersecting the centerlines of the tubes 13 of the other layer 12, preferably at an angle of 90°. Shown in FIG. 1 are self-contained elastic tubes 13 which are isolated from one another.

The individual elastic tubes 13 are preferably filled, or fillable, with a damping medium (not shown) especially with a gaseous or liquid damping medium, in particular air or water. Furthermore, the elastic tubes 13 can likewise be filled, either partially or completely, with a fire-retardant and/or fireproof medium (not shown). At the same time, this medium can serve as the damping medium, particularly when the damping medium is water or another liquid possessing fire-retardant or fire-extinguishing properties and which thus serves as an extinguishing agent. But it is also conceivable to mix the damping means with additives which impart fire-retardant and/or fire-extinguishing properties to the damping medium, if appropriate, to a gaseous damping medium as well.

Figure 2:
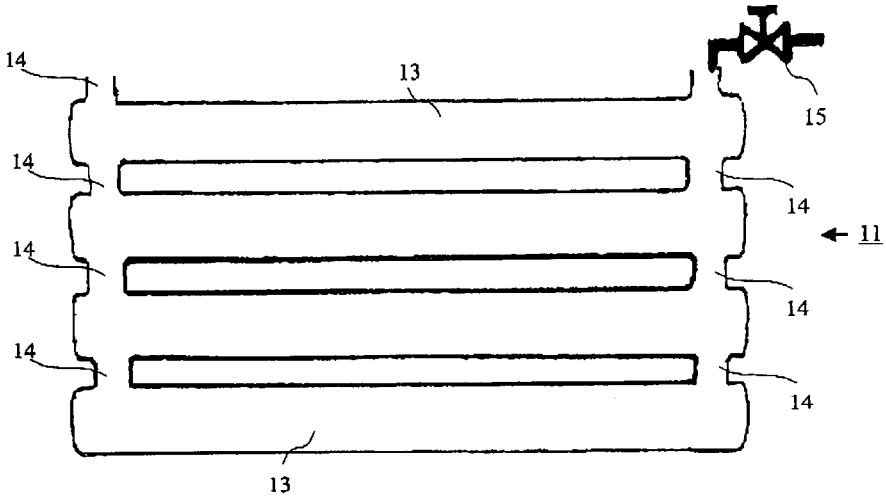
FIG. 2 shows a segment of interconnected elastic tubes which are filled or are fillable with a damping medium.

FIG. 2 shows a section of a layer 11 of interconnected elastic tubes 13. A connection piece 14 is provided to connect two elastic tubes 13 each. Also shown is a valve 15 for filling the individual elastic tubes 13 with a damping medium. The valve 15 can be used to set the pressure of the damping medium in the elastic tubes 13. It is also possible to change the damping medium depending on the embodiment and application of the support. Possible damping media are in particular gaseous or liquid damping media, such as air, gas, water, gel, etc. The connection 14 between the individual elastic tubes 13 is advantageously arranged at the respective outer ends of the elastic tubes 13. This manner of connecting the elastic tubes 13 fixes them in their relative position to one another. The connection 14 between the individual elastic tubes 13 results in a kind of "interactive cushioning" because pressure exerted on one or more elastic tubes 13 causes damping material to escape these elastic tubes 13 proportional to the pressure exerted upon them and to be distributed in the connected elastic tubes 13.

Figure 3:
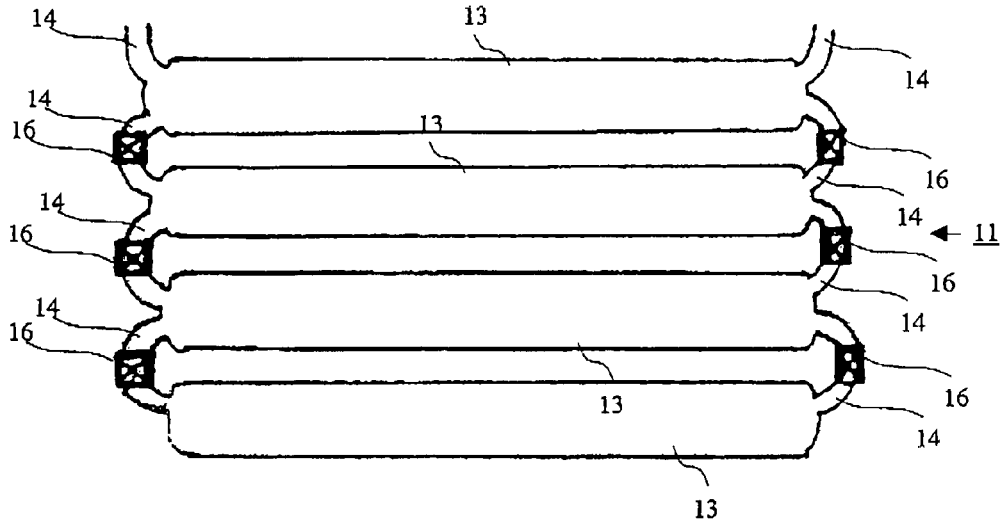
FIG. 3 shows a segment of elastic tubes which are connected to each other by pressure equalization means and which are filled or are fillable with a damping medium.

FIG. 3 shows an exemplary embodiment pursuant to FIG. 2 in which all or selected connection pieces 14 are each configured with a flow control valve 16. Such flow control valves 16 can be used to influence the dynamic behavior of a layer 11 of interconnected elastic tubes 13. The flow control valves 16 are adjustable or fixed flow control valves. Ideally, the flow control valves 16 are configured with a mechanical, pneumatic or hydraulic adjustment means, thus providing a simple means of adjusting the dynamic behavior of the layer 11 of elastic tubes 13 with merely one adjustment medium.

Figure 4:
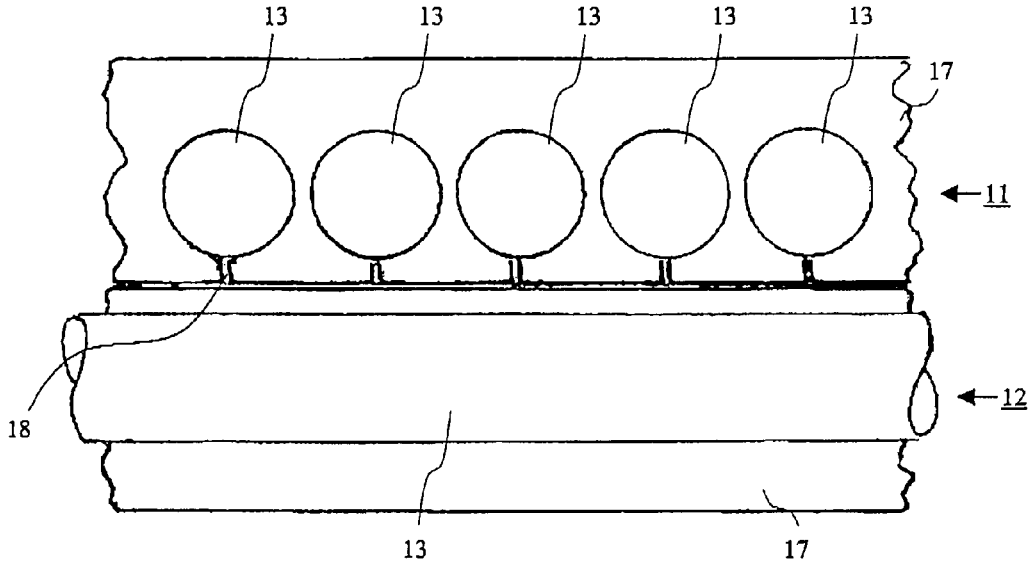
FIG. 4 shows two layers of elastic tubes, with each layer being embedded in an elastic material, such as polyurethane foam

FIG. 4 shows an embodiment of the core 10 of the support with two layers 11, 12 of elastic tubes 13, with each layer 11, 12 being surrounded by an elastic material 17. The elastic material 17 is a plastic foam, in particular polyurethane foam. For accommodating the elastic tubes 13, the elastic material 17 has indentations 18 on one side that open into recesses designed preferably to correspond to the diameter of the elastic tubes 13 to be embedded in the material.

Figure 5:
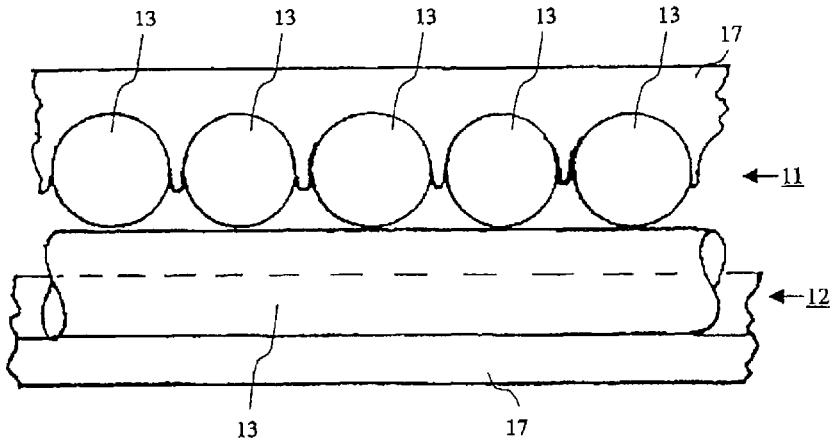
FIG. 5 shows two layers of elastic tubes, with each layer being partially surrounded by an elastic material, such as polyurethane foam.

FIG. 5 shows a variant on the embodiment pursuant to FIG. 4. In this variant, the layers 11, 12 of the elastic tubes 13 are only partially encompassed by the elastic material 17. The embedding of the elastic tubes 13 in the elastic material 17 according to the embodiment pursuant to FIG. 4 or FIG. 5 achieves an advantageous fixation of the elastic tubes 13 in the overall installation.

Figure 6:
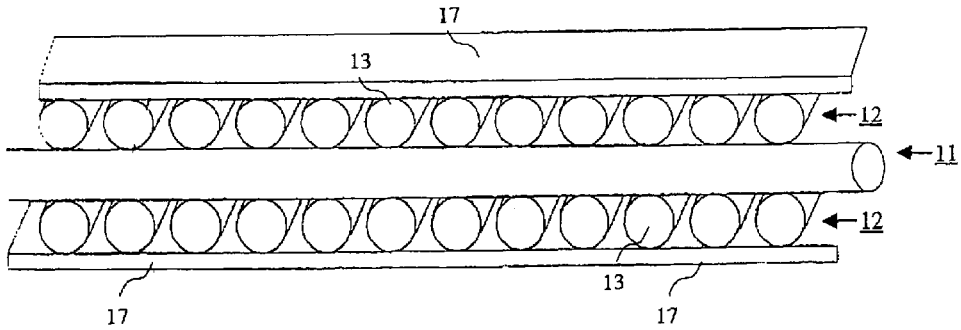
FIG. 6 shows two layers of elastic tubes, with each layer being covered by an elastic material, such as polyurethane foam.

FIG. 6 shows a further variant of a core of a support with layers 11, 12 of elastic tubes 13 lying crosswise on top of one another. In the illustrated embodiment, the two outer layers 11 of the elastic tubes 13 are covered by an elastic material 17.

Figure 7:
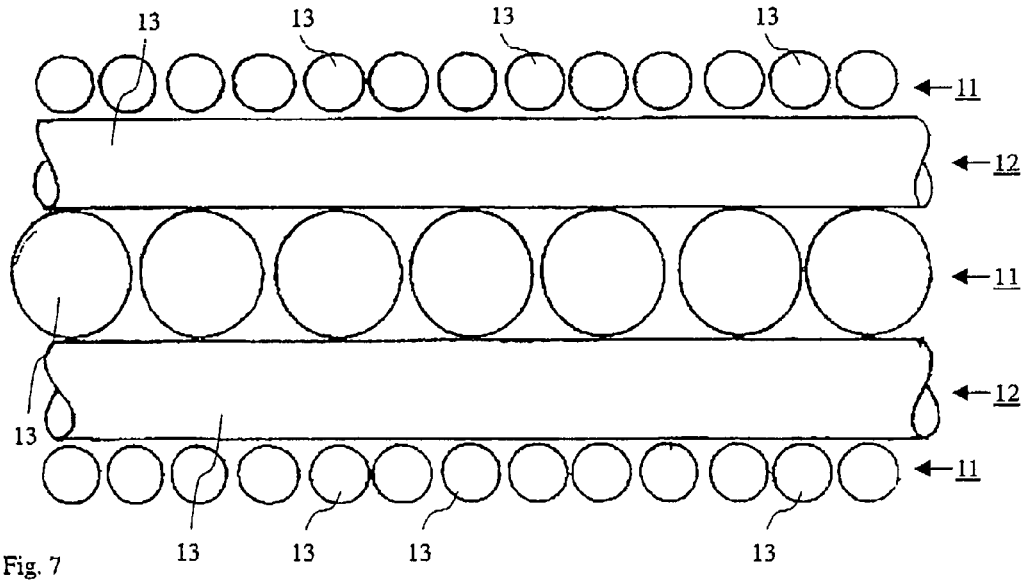
FIG. 7 shows a core of a support with more than two layers of elastic tubes.

FIG. 7 shows the construction of a core 10 of a support having more than two layers 11, 12. It shows five layers 11, 12, each with elastic tubes 13 lying crosswise to those of the adjacent layers. The diameter of the elastic tubes 13 in the shown construction decreases from the interior to the exterior, with the result that at the outer part of the support there is a greater number of parallel tubes 13 at both the top and the bottom than in the center or inner layers 11, 12. This arrangement increases the support surface of the overall installation. A lying or sitting human body is thereby provided with optimum support. Particularly advantageous in a multi-layer construction such as the one shown in FIG. 7 is that it is possible to utilize a combination of different damping media, e.g. a liquid damping medium, such as water, for the interior layers and a gaseous damping medium, such as heat-insulating air, for the outer layers. For achieving greater support height with less material it is possible to employ elastic tubes 13 with greater diameter in the interior of the core.

Figure 8:
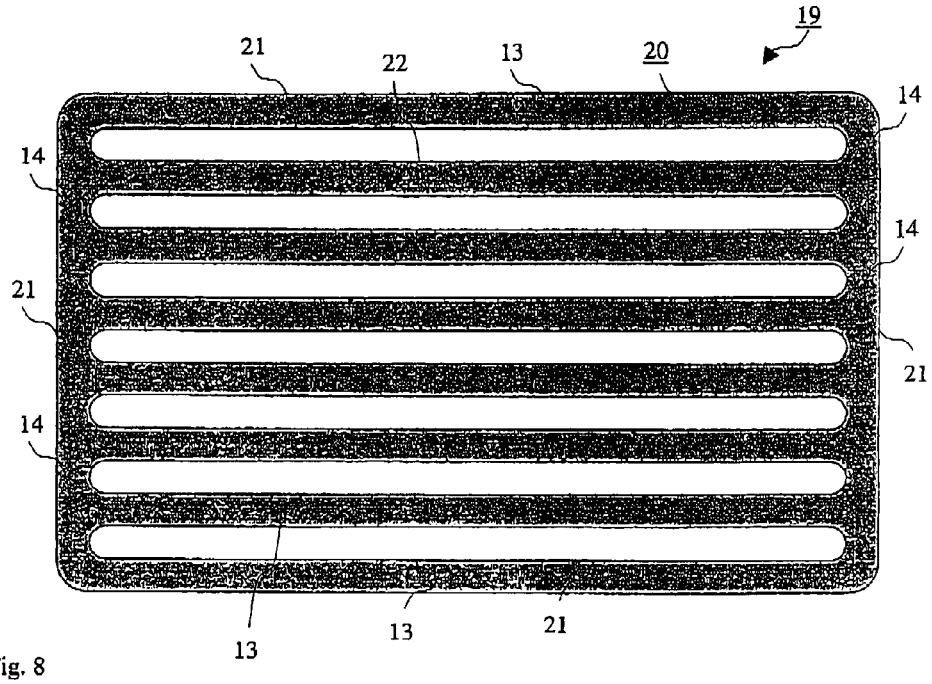
FIG. 8 shows a segment of elastic tubes formed by the welding and punching out of two foils.

FIG. 8 details a way of producing a layer of interconnected elastic tubes 13. For producing the tube elements 19 shown, two foils 20 lying one above the other—of which only one, namely the upper foil, is visible in FIG. 8—are welded and punched out. In the process, the tube element 19 is formed with an outer, circumferential welding seam 21 and a plurality of inner welding seams 22. The punching operation is performed outside of the welding seams 21, 22. As an alternative, the tubes 13 can also be formed from flexible tube sections, in particular tubular foils, which are closed at the ends.

Figure 9A:
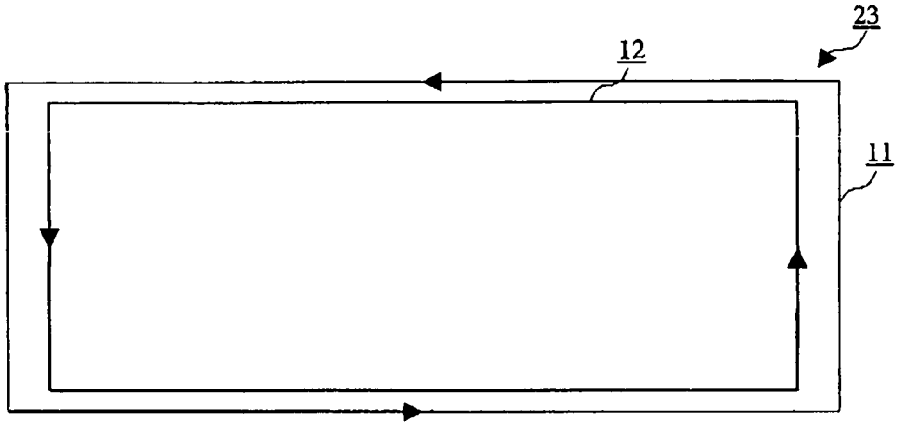
FIG. 9*a* shows a mattress with two layers of elastic tubes such that the elasticity of the mattress for the longitudinal and transverse direction can be set independently.
Figure 9B:
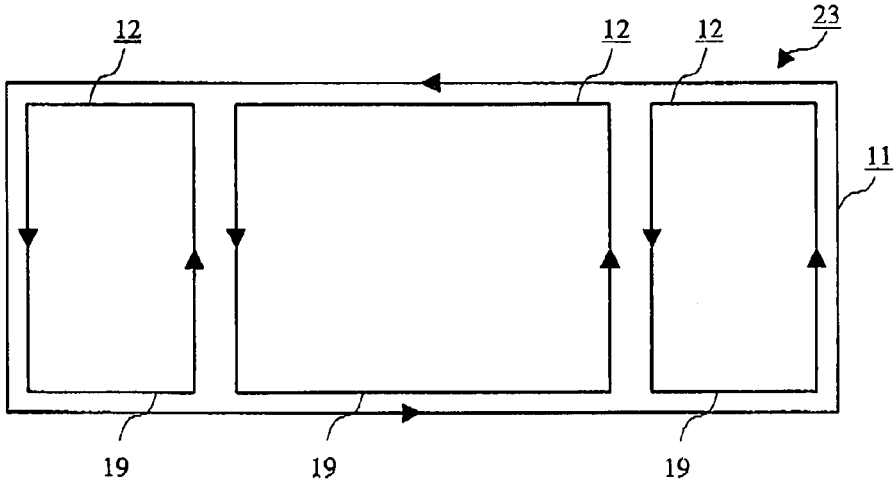
FIG. 9*b* shows a mattress with two layer of elastic tubes, with one layer encompassing a plurality of segments of elastic tubes, making it possible to set the elasticity of the mattress for the longitudinal and transverse direction and for each individual segment independently of each another.
Figure 9C:
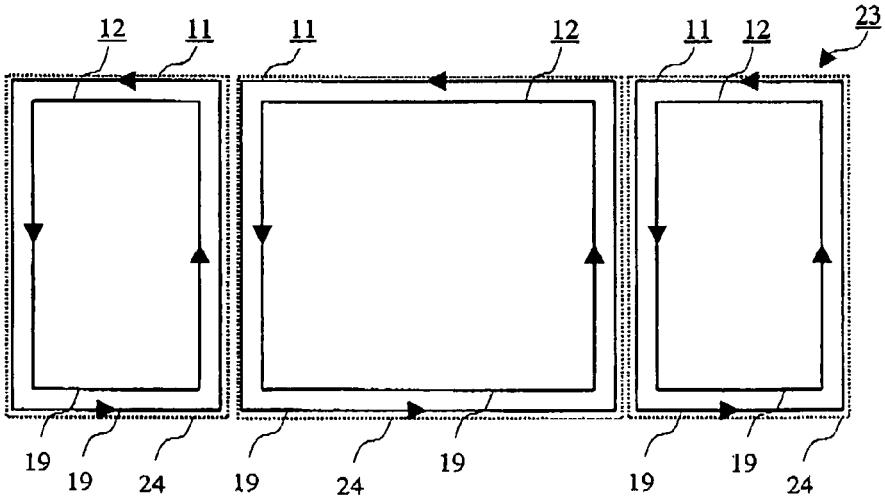
FIG. 9*c* shows a mattress with two layer of elastic tubes, with each layer encompassing a plurality of segments of elastic tubes, making it possible to set the elasticity of the mattress for the longitudinal and transverse direction and for each individual segment independently of each another.

FIGS. 9*a*, 9*b* and 9*c* now show different ways of influencing the elasticity of a mattress formed by supports of the described kind in the longitudinal and transverse direction. FIG. 9*a* shows a schematic top view of a mattress 23. The mattress 23 encompasses two layers 11, 12 of elastic tubes 13 lying crosswise on each other, i.e. a support of the aforesaid type with two layers 11, 12 of elastic tubes or two supports having one layer 11, 12 of elastic tubes 13 each. The individual elastic tubes 13 are not shown, instead only the horizontal or vertical lines are highlighted by a center arrow. A first layer 11 of elastic tubes extends parallel to the longitudinal direction of the mattress 23. A second layer 12 of elastic tubes extends perpendicular to the longitudinal direction (transverse direction) of the mattress 23. By influencing the elasticity of the elastic tubes 13 of the first layer 11, it is possible to exert an influence on the elasticity of the mattress 23 in the longitudinal direction. By influencing the elasticity of the elastic tubes 13 of the second layer 11, it is possible to influence the elasticity of the mattress 23 in the transverse direction. Thus, it is possible to influence the elasticity of the mattress 23 in both the longitudinal and transverse directions independently. FIG. 9*b* shows a variant of the mattress 23 from FIG. 9*a*. Again, a first layer 11 of elastic tubes 13 is provided which is aligned to the longitudinal extension of the mattress 23. The second layer 12 of elastic tubes 13 is formed by segments of elastic tubes, e.g. tubular elements 19. In the shown example, the second layer 12 encompasses three tubular elements 19, i.e. a tubular element 19 for a head region, a further tubular element 19 for a foot region and finally a third tubular element 19 for a torso area of the mattress 23. For the illustrated mattress 23, it is possible to establish its elasticity in the longitudinal direction by acting on the elasticity of the elastic tubes 13 of the first layer 11. The elasticity of the elastic tubes 13 of the second layer 12 of the mattress 23 can be adjusted differently for each tubular element 19. In other words, the elasticity in the head, torso and foot region of the mattress 23 can be adjusted in the transverse direction for each region independently of one another. FIG. 9*c* shows a further variant embodiment of the mattress 23. Here the mattress 23 is fashioned with three tubular elements 19 in the second layer 12, as already described with respect to FIG. 9. Furthermore, the elastic tubes 13 of the lower layer 11, which previously (FIGS. 9*a*, 9*b*) ran continuously across the entire longitudinal extent of the mattress 23, are now partitioned in individual segments of elastic tubes, e.g. tubular elements 19. This makes it possible to adjust each mattress section 24, i.e. the head, torso and foot sections, individually with respect to its elasticity in the longitudinal and transverse direction. Each mattress section 24 can be regarded as a support of the type described above, having two layers 11, 12 of elastic tubes 13. The mattress 23 of the exemplary embodiment pursuant to FIG. 9*c* is thus comprised of adjacently arranged supports.

LIST OF DESIGNATIONS

10 core
11 layer
12 layer
13 elastic tube
14 connection piece
15 valve
16 flow control valve
17 elastic material
18 indentation
19 tubular element
20 foil
21 welding seam
22 welding seam
23 mattress
24 mattress section

What is claimed is:

1. A support for a human body, characterized by at least two layers (11, 12) of elastic tubes (13) with a longitudinal extension parallel to a plane defined by the support, with the alignment of the elastic tubes (13) of a first layer (11) differing from the alignment of the elastic tubes (13) of a second layer (12), and wherein the elastic tubes (13) are embedded in an elastic material (17).

2. The support according to claim 1, characterized in that in the at least two layers (11, 12) are arranged such that a plurality of the elastic tubes (13) are in parallel alignment to one another and are spaced apart from one another.

3. The support according to claim 1, characterized in that the elastic tubes (13) of the first layer (11) run crosswise to the elastic tubes (13) of the second layer (12), with the elastic tubes (13) of the first layer (11) being arranged essentially perpendicular to the elastic tubes (13) of the second layer (12) and the elastic tubes (13) of the different layers (11, 12) making a point contact with each other at crosspoints.

4. The support according to claim 1, characterized in that the individual elastic tubes (13) are filled or can be filled with a gaseous or liquid damping medium.

5. The support according to claim 4, characterized in that the filled or fillable elastic tubes (13) are connected to one another as a layer or segment, by means of pressure equalization means.

6. The support according to claim 1, characterized in that at least some of the elastic tubes (13) in the first layer (11) are provided at least in part with a fire-retardant and/or fire-extinguishing means.

7. The support according to claim 1, characterized in that the elastic tubes (13) have an essentially circular cross-section, with the elastic tubes (13) of the first layer (11) having a diameter which deviates from the diameter of the elastic tubes (13) of the second layer (12).

8. The support according to claim 1, characterized in that in addition to the first and second layer of elastic tubes (13), a further layer (11) of elastic tubes (13) is provided.

9. The support according to claim 1, characterized in that the elastic tubes (13) in different layers (11, 12) are filled with different damping media.

10. The support according to claim 1, characterized in that the at least two layers (11, 12) of elastic tubes (13) are formed by the welding of two foils (20).

11. The support according to claim 1, characterized in that at least some of the elastic tubes (13) are hose-like, flexible tubes.

* * * * *